US005504469A

United States Patent [19]

McGrane

[11] Patent Number: 5,504,469

[45] Date of Patent: Apr. 2, 1996

[54] ELECTRICAL CONDUCTORS

[75] Inventor: Kevin McGrane, Bury St Edmunds, United Kingdom

[73] Assignee: Electronic Techniques (Anglia) Limited, United Kingdom

[21] Appl. No.: 173,373

[22] Filed: Dec. 23, 1993

[30] Foreign Application Priority Data

Dec. 24, 1992 [GB] United Kingdom ..... 9226925

[51] Int. Cl.[6] ..... H01F 27/28

[52] U.S. Cl. ..... 336/206; 336/205; 336/182; 336/174; 336/96

[58] Field of Search ..... 336/180, 182, 336/205, 206, 173, 174, 229, 186, 96; 174/113 R, 113 AS, 119 R, 120 R

[56] References Cited

U.S. PATENT DOCUMENTS

| | | | |
|---|---|---|---|
| 1,727,955 | 9/1929 | Biggar . | |
| 1,904,873 | 4/1933 | Markuson . | |
| 3,312,775 | 4/1967 | Lambert | 174/120 |
| 3,484,532 | 12/1969 | Anderson | 174/36 |
| 4,568,797 | 2/1986 | Binder et al. | 174/128 R |
| 4,851,060 | 7/1989 | Wade, Jr. et al. | 156/53 |
| 5,059,263 | 10/1991 | Sahakian et al. | 156/56 |

FOREIGN PATENT DOCUMENTS

| | | |
|---|---|---|
| 133220A2 | 7/1984 | European Pat. Off. . |
| 363064A1 | 9/1989 | European Pat. Off. . |
| 397373A2 | 5/1990 | European Pat. Off. . |
| 460506A2 | 5/1991 | European Pat. Off. . |
| 211939 | 11/1972 | France . |
| 2150050 | 4/1973 | France . |
| 3039549 | 10/1980 | Germany . |
| 3107059 | 2/1981 | Germany . |
| 3738410 | 5/1989 | Germany . |
| 55-11861 | 4/1980 | Japan . |
| 57-18871 | 7/1982 | Japan . |
| 62-293705 | 12/1987 | Japan . |
| 796811 | 7/1956 | United Kingdom . |
| 1056922 | 1/1965 | United Kingdom . |
| 1106550 | 5/1965 | United Kingdom . |
| 1256933 | 4/1969 | United Kingdom . |
| 1347778 | 12/1971 | United Kingdom . |
| 1391219 | 9/1972 | United Kingdom . |
| 2065062 | 12/1979 | United Kingdom . |
| 2230208 | 2/1990 | United Kingdom . |
| 2235827 | 7/1990 | United Kingdom . |

*Primary Examiner*—Laura Thomas

*Attorney, Agent, or Firm*—Dorn, McEachran, Jambor & Keating

[57] ABSTRACT

Electrical isolation which is required between adjacent windings of a device such as a transformer is provided by wrapping a group of individually insulated conductive cores 62, 64, 66, 68 with multiple turns of a thin tape 32. Use of a thin tape rather than solid insulation provides a long creepage path from the cores 62, 64, 66, 68 to adjacent components. The invention can also be applied to components other than transformers.

24 Claims, 3 Drawing Sheets

ELECTRICAL CONDUCTORS

This invention relates generally to electrical conductors, and in particular to conductors used for the winding of electric coil devices such as transformers. The invention also relates to electric coil devices wound with such materials.

The conductor of the invention is particularly useful in winding signal transformers as opposed to power transformers. Signal transformers deal with the transmission of signals, usually at low power levels (less than 1 watt). Included amongst signal transformers are transformers used in telecommunications applications, for example for line matching, wideband transformers and pulse transformers. For the purposes of this patent application, telecommunication applications can be defined as those applications where transformers are used in circuits designed to permit communication over distances exceeding one meter.

In the construction of transformers, it is necessary to electrically isolate the primary and secondary windings from one another. Industrial standards have been laid down to specify in detail the required isolation for specific applications. In particular International Standard EN 60 950/A1:1993 requires that solid insulation between primary and secondary windings should have a minimum thickness. Where thin film insulation is used, a minimum number of film thicknesses have to be provided and all creepage paths must have a minimum length. The actual quantitative values for the required isolation depend upon the transformer isolation class, the working voltage and the environment in which the transformer is to qualify.

There is always a desire to achieve miniaturisation of electronic components, but the need to take into account minimum insulation thicknesses and minimum creepage distances limits the extent to which miniaturisation can take place for a given type of construction. For the purposes of this specification, miniature components are those weighing less than 100 g. In high frequency signal transformer applications, the insulation requirements are often the determining factor in regard to size, flux densities and winding resistances being relatively unimportant It is possible to provide the creepage distance, that is the shortest distance between two conductors measured along the surfaces of thin film insulation between the conductors, by isolating the conductors with a thin insulating tape which is wound around them. A construction of this type is shown, for example, in European Patent Specification 0 460 506. In this construction, each conductor is wound individually with insulating tape. This provides appreciable space saving, allowing components to be reduced in size, but still further space reduction is desirable.

Accordingly, the invention provides an insulated electrical conductor comprising a plurality of separate and distinguishable conductive cores, each core having an enamelled covering to insulate it from neighbouring cores, the cores being combined to form a multi-core elongate conductor which is covered by insulation tape wound in a helical path around the cores and which forms a common external insulating layer for the conductor.

Because the wound insulation is not regarded as solid insulation, the creepage path from the cores must be regarded as extending between the turns of tape around the cores or across part of the width of the tape and by establishing multiple turns of tape of suitable width the creepage path can very quickly be extended to any desired length.

The external diameter of the conductor is suitably no greater than 1.5 mm, and conductors of this dimension are useful in signal transformers and similar electric coil devices. The number of cores is preferably eight or less, and the cores can be distinguishable from one another by providing them with enamelled coverings of different colours. The enamelled coverings can have a thickness less than 70 μm.

The insulation material tape preferably has a thickness less than 100 μm, and may be wound in such a way that each turn of the tape overlaps at least the two preceding turns.

The tape winding is preferably constructed such that the creepage distance between the conductor and the external environment is sufficient to meet desired criteria of International Standard EN 60 950.

The invention also provides an electric coil device in which at least some of the windings comprise a conductor as set forth above.

The electric coil device may be a transformer, typically a signal transformer.

The thin tape is preferably wound in a helical path around the wire cores, and adjacent turns of the tape preferably overlap preceding turns. It is preferred for each turn to overlap sufficient preceding turns so that a spiral path along the surface of the tape has a length equal to or greater than the required creepage distance.

The thin tape is preferably of a material which has a high dielectric breakdown strength. The material may, for example, be polyester, polyimide or polyetherimide, and the tape can be provided in the form of a continuous tape of, for example, 10–25 μm thickness.

The invention also provides a method of optimizing the ratio of primary inductance to leakage inductance ($L_p/\Delta L$) of a transformer, wherein at least one of the transformer windings comprises turns of an insulated electrical conductor comprising a plurality of separate and distinguishable conductive cores, each core having an enamelled covering to insulate it from neighbouring cores, the cores being combined to form a multi-core elongate conductor which is covered by a tape of insulation material wound in a helical path around the conductor and which forms a common external insulating layer for the cores, the primary and secondary windings are wound in the same winding space on a transformer core, and the turns of the two windings are intermingled to produce a desired primary inductance to leakage inductance ratio.

The invention will now be further described, by way of example, with reference to the accompanying drawings, in which.

Figure 1:
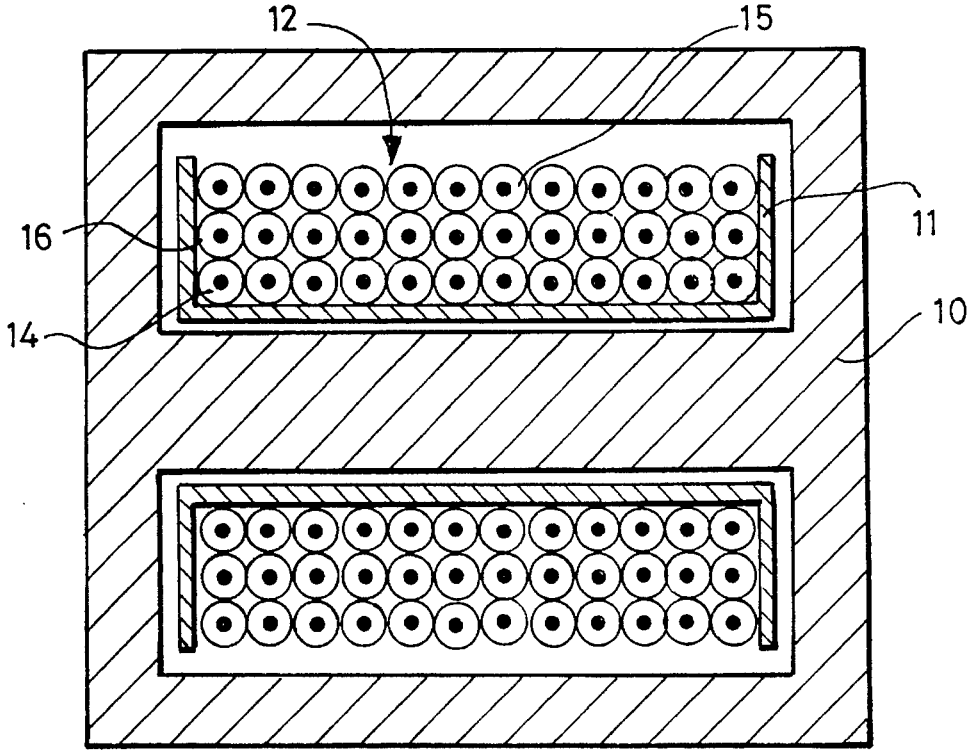
FIG. 1 is a schematic section through a signal transformer in accordance with the prior art.
Figure 2:
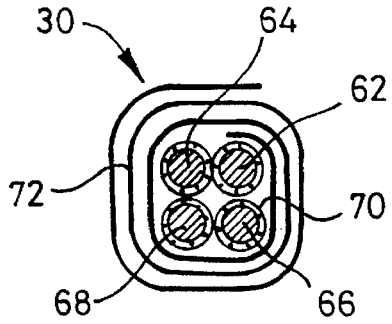
FIG. 2 is a cross-section through a conductor in accordance with the invention.
Figure 3:
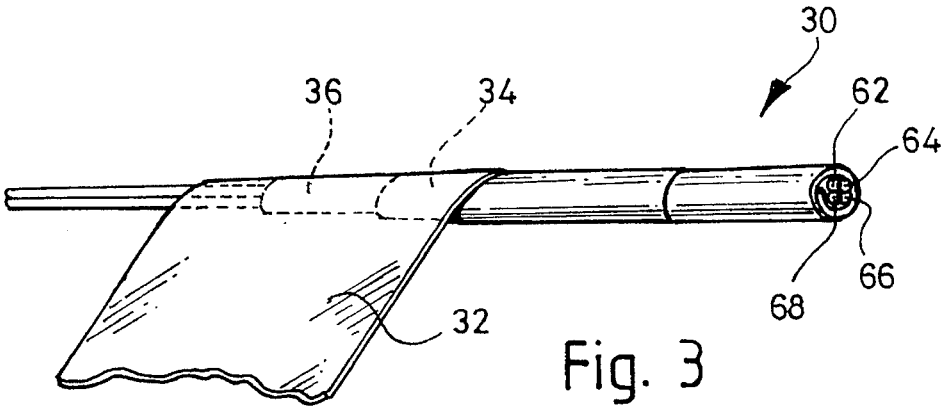
FIG. 3 is a perspective view showing cores of the conductor being helically wound with tape, in accordance with the invention.
Figure 4A:
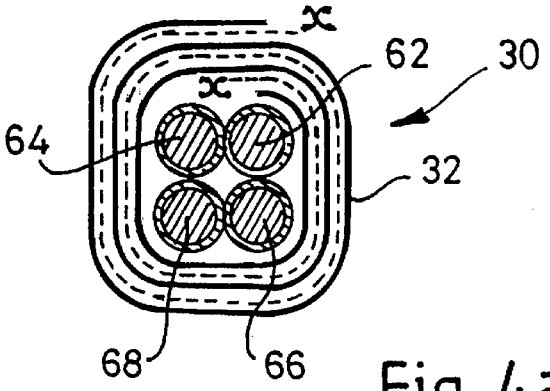
Figure 4B:
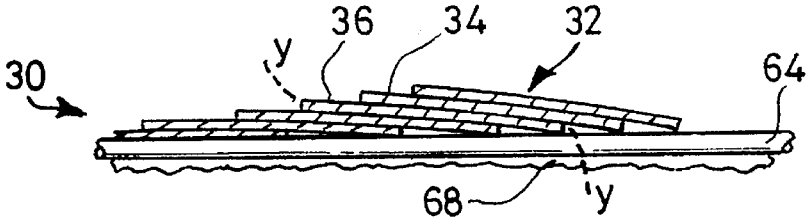
Figure 5:
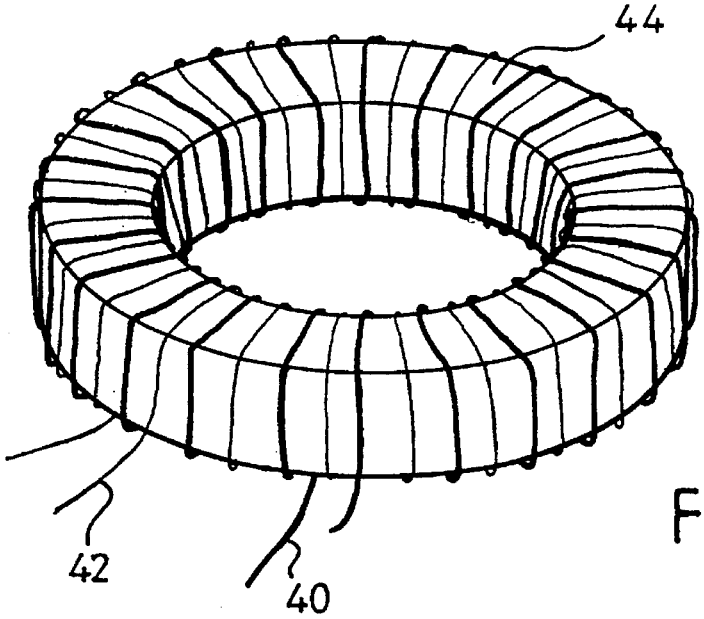
Figure 6:
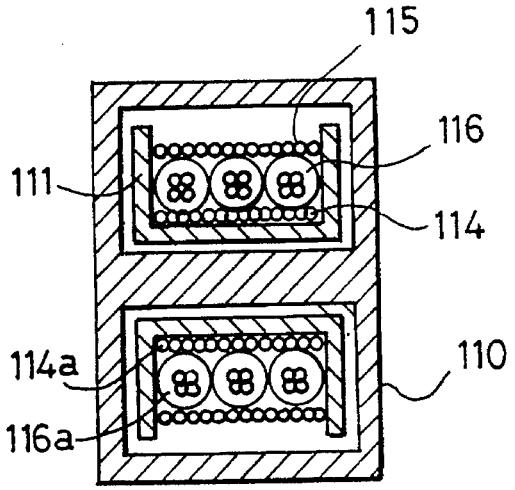
Figure 7:
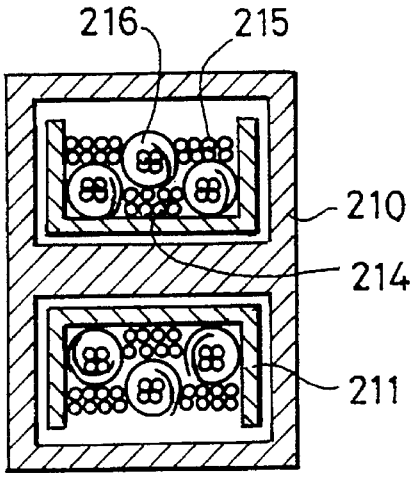
Figure 8:
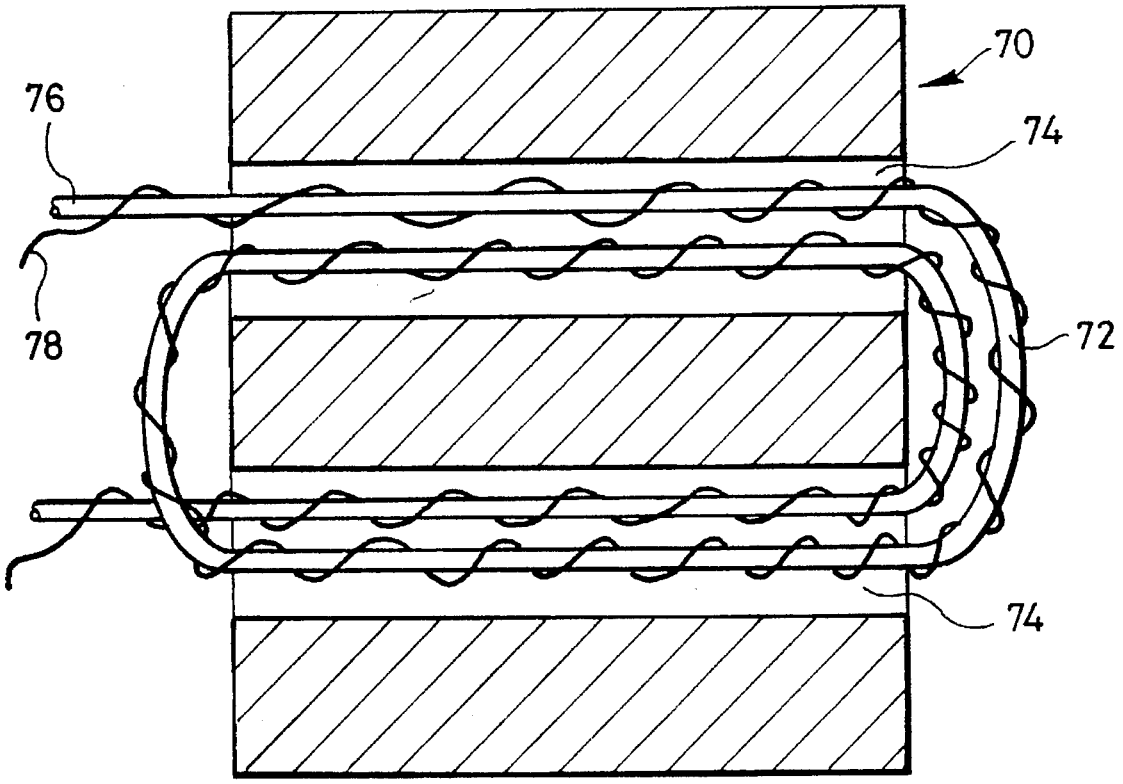

FIGS. 4*a* and 4*b* are respectively radial and axial sections through the wound conductor of FIGS. 2 and 3; and FIGS. 5, 6, 7 and 8 are illustrations of alternative forms of transformer in accordance with the invention. FIGS. 6 and 7 are drawn to generally the same scale as FIG. 1, whilst FIGS. 5 and 8 are drawn to other scales.

FIG. 1 shows a prior art transformer construction with a magnetic core 10 around a bobbin 11 on which windings 12 are wound. The windings, which consist of turns of an insulated conductor, form primary windings 14 and 15 and a secondary winding 16. The insulated conductor forming the windings is produced by wrapping insulating tape around a conductive wire core.

In a signal transformer the volume of magnetic core required to accommodate the construction and to form a magnetic circuit is often much greater than that required simply to satisfy magnetic requirements. This is seen in the construction of FIG. 1, in that the insulating tape occupies a substantial proportion of the space within the bobbin.

In order to reduce the volume occupied by the windings, the invention proposes that one, or both, of the primary and secondary windings consist of multi-core conductors insulated with a helically wound sheath as shown in FIGS. 2 and 3.

FIG. 2 shows a conductor generally designated 30 which has four conductive cores 62, 64, 66 and 68. Each of these cores has an enamelled insulating coating 70, and the bundle of four conductors is isolated from other conductors by a wound thin tape 72. The cores will be marked in some way to enable them to be distinguished from one another. For example, the enamelled insulating coatings on the different cores can be different colours. The four cores 62, 64, 66 and 68 contained in the bundle need only be isolated from one another with nominal operational insulation as they are all on the same side of an isolation barrier.

FIG. 3 shows the conductor 30 in the process of being insulated by a thin film tape 32. The tape 32 is of a material used for thin film insulation (eg polyester, polyimide or polyetherimide), and is wound onto the cores 62, 64, 66, 68 along a helical path. From FIG. 3 it will be seen that each turn of the tape 32 overlaps two preceding turns 34 and 36. As a result, the final cross-section of the wound conductor appears as shown in FIGS. 4*a* and 4*b*. It must be noted that in FIG. 4*a* the tape 32 is shown wound loosely around the cores 62, 64, 66 and 68, with an air gap between. In practice of course the tape will be wound tightly, with the adjoining layers of tape cemented together, and there will be no such air gap.

However in terms of the isolation of the cores 62, 64, 66 and 68, the multi-layer wound tape 32 has the properties of thin film insulation rather than of solid insulation. The creepage path leading from the cores of the conductor 30 will therefore either follow a spiral path between the turns of the tape 32, as indicated by the line x—x in FIG. 4*a*, or will follow an axial path from an edge of the tape 32 to the cores 62, 64, 66 and 68 as indicated by the line y—y in FIG. 4*b*. This distance will be considerable relative to a radius of the insulated cores and therefore the necessary isolation can be achieved with a relatively low overall diameter. The width of the tape 32 and the helical pitch of the winding must be chosen to achieve the desired minimum number of overlapping layers and the desired creepage distance.

FIG. 6 shows how the overall size of a transformer can be reduced by this method. In FIG. 6, parts which are equivalent to parts already described with reference to FIG. 1 are identified by the same reference numerals with the addition of a preceding "1". The secondary windings 116 of this transformer are formed by multiple core conductors wound with a sheath in accordance with FIGS. 2 and 3 whilst the primary windings are conventionally insulated.

Because the creepage path requirements are achieved with the wound insulation on the secondary windings, the primary windings require only nominal (enamel) insulation and therefore the twelve turns of primary winding shown in each layer in FIG. 1 can be accommodated in a much smaller space, as shown in FIG. 6. The volume of insulation required to insulate the twelve turns of the secondary winding is also much less when these turns are grouped in groups of four as shown. This allows a major size reduction of the transformer, such that the relative dimensions of a transformer constructed according to the principles of the invention compare with the dimensions of a prior art construction approximately in the ratios shown in FIGS. 1 and 6 of the drawings.

The creepage path from the turn 114*a* to the turn 116*a* now follows the path x—x or the path y—y (as previously described) before reaching the cores 62, 64, 66, 68 of the conductor 30 forming the secondary winding. Because of the provision of the necessary creepage path in this way, the actual quantity of winding tape required to achieve the necessary isolation is much reduced, leaving more space for the windings and allowing much greater scope for miniaturisation. Furthermore, the windings may be intermingled in any way, for example as shown in FIG. 7 (where parts which are equivalent to parts already described with reference to FIG. 1 are identified by the same reference numerals with the addition of a preceding "2"), for any electrical, electromagnetic or manufacturing advantage. By selecting the degree of intermingling, the ratio of primary inductance to leakage inductance ($L_p/\Delta L$) (which largely determines the transformer operating bandwidth) can be optimised for a given transformer core geometry.

By isolating the windings in this way, it becomes possible to also construct a toroidal transformer which meets the stringent isolation requirements, generally as shown in FIG. 5. In this Figure the thick black lines indicate a helically wound multi-core conductor 40 and the thin black lines indicate a conventionally insulated single core conductor 42. The conductors are wound in a known manner on a magnetic core 44 in the shape of a toroid and there will be sufficient isolation between the primary and secondary windings as a result of the long creepage paths x—x and y—y which result from the helical sheath. Toroidal transformers of this type are particularly appropriate for miniaturisation.

FIG. 8 shows a section through a magnetic core 70 with multiple holes 74 and wound with isolated windings 72. The primary winding comprises a conductor 76 which is helically wound with thin film insulation as previously described and the secondary winding comprises a conductor 78 twisted around the conductor of the primary winding, so that both windings can be assembled onto the core in one operation. The conductor 78 can be a single insulated wire, or multiple individually insulated wires, twisted around the conductor 76. This assembly can reduce not only manufacturing costs, but also the leakage inductance of the transformer.

In many cases, transformers wound in the manner described above will, after winding, be sealed to exclude dust and moisture. This can be done by encapsulation, potting or impregnation. The effect of such sealing is that the isolation which the component is required to have can be satisfied by less stringent constructional requirements. This means that shorter creepage paths can be allowed which produces benefits by allowing a smaller conductor OD which in turn leads to smaller overall dimensions for the component. Also there is a further beneficial effect on leakage inductance.

Tape-wrapping multiple cores in this way permits multifilar winding to produce, for example, a) accurate taps and/or b) bunched or 'litz' conductor for low-loss high-frequency performance and/or c) transmission line construction and/or d) fewer turns for a given inductance by series-aiding the cores.

The conductor cores can be connected in series, parallel or a combination of both to achieve the above advantages.

The separate conductor cores could be, for example, one or more coaxial pairs rather than single enamelled wire cores.

Of the above advantages, (d) has major benefits as it permits i) lower cost (less tape-wrapped conductor)

ii) more efficient utilisation of insulation leading either to miniaturisation or to more winding space iii) faster winding (since there will be fewer turns).

With single core tape-wrapped conductor as in the prior art, there are limits to reducing the outside diameter (OD) of the conductor by reducing the conductor size. For example, to maintain a creepage path of 4 mm along the tape surfaces the inner core becomes extremely fine for an OD below approx 0.4 mm and it then becomes difficult (and expensive) or impossible to tape-wrap. However for a finished OD of 0.5 mm, four twisted cores forming an overall diameter of 0.25 mm represent a strong assembly which can be wrapped with ease.

The packing improvement of 0.5 mm OD quadrifilar over 0.4 mm single core is clear as 100 turns of 0.4 mm, for example, would be replaced by 25 turns of 0.5 mm. Required winding space is reduced by over 60%, and if the multi-core, insulated winding is single layer, the winding breadth is reduced by nearly 70%.

Further benefits are obtained by encapsulation of the wound assembly. Following the requirements of International Standard EN 60 950/A1:1993, if the wound assembly is encapsulated, the creepage paths required by the standard for a given level of insulation can be reduced. The necessary requirements can then be achieved using less insulating tape and therefore in a lesser volume, all of which aids miniaturisation.

All of the above concepts can significantly aid miniaturisation of transformers, in particular for signal transformers. The invention is not solely applicable to transformers, but can also be applied to other electronic coil devices such as chokes where conductor windings are applied and where miniaturisation is desirable.

I claim:

1. An insulated electrical conductor comprising a plurality of separate conductive cores, each core being marked so as to be distinguishable from other cores, each core having an enameled covering to insulate it from neighboring cores, the cores being combined to form a multi-core elongate conductor which is covered by insulation tape wound in a helical path around the cores and which forms a common external insulating layer for the conductor.

2. A conductor as claimed in claim 1, wherein the cores are covered by a single insulating tape wound in a helical path.

3. A conductor as claimed in claim 1, wherein the external diameter of the conductor is no greater than 1.5 mm.

4. A conductor as claimed in claim 1, wherein the number of cores is no more than eight.

5. A conductor as claimed in claim 4, wherein there are four cores.

6. A conductor as claimed in claim 1, wherein the enamelled coverings of the cores are of different colours to enable the cores to be distinguished from one another.

7. A conductor as claimed in claim 1, wherein the enamelled coverings have a thickness less than 70 μm.

8. A conductor as claimed in claim 1, wherein the insulation tape has a thickness less than 100 μm.

9. A conductor as claimed in claim 1, wherein the insulation tape is formed of one of polyester, polyimide and polyetherimide.

10. A conductor as claimed in claim 1, wherein each turn overlaps sufficient preceding turns so that a spiral path along the surface of the tape has a length at least equal to the required creepage distance.

11. A conductor as claimed in claim 1, wherein the tape is wound in such a way that each turn of the tape overlaps at least the two preceding turns.

12. A conductor as claimed in claim 1, wherein the creepage distance between the conductor and the external environment is sufficient to meet International Standard EN 60 950.

13. A conductor as claimed in claim 1, wherein the width of the tape and the axial overlapped distance between adjacent turns are such that an axial path from an edge of the tape at the outer circumference of the wound conductor to the core, between the turns, has a length equal to or greater than the required creepage distance.

14. An electric coil device wound, at least in part, with an insulated electrical conductor comprising a plurality of separate and distinguishable conductive cores, each core having an enamelled covering to insulate it from neighbouring cores, the cores being combined to form a multi-core elongate conductor which is covered by insulation tape wound in a helical path around the cores and which forms a common external insulating layer for the conductor.

15. A device as claimed in claim 14 which is a transformer.

16. A device as claimed in claim 14 which is a signal transformer.

17. A device as claimed in claim 14 which is a miniature signal transformer.

18. A device as claimed in claim 14 which is a signal transformer for telecommunications applications.

19. A device as claimed in claim 15, having primary and secondary windings, wherein one of the windings is formed by an insulated electrical conductor comprising a plurality of separate and distinguishable conductive cores, each core having an enamelled covering to insulate it from neighbouring cores, the cores being combined to form a multi-core elongate conductor which is covered by insulation tape wound in a helical path around the cores and which forms a common external insulating layer for the conductor, and the other of the windings is formed by a conductor core which is insulated with nominal operational insulation.

20. A device as claimed in claim 19, wherein the conductor forming said other of the windings is mechanically coupled with the conductor forming said one of the windings.

21. A device as claimed in claim 20, wherein the conductor forming said other of the windings is wound around the conductor forming said one of the windings.

22. A device as claimed in claim 19, wherein the primary and secondary windings are intermingled within the winding space.

23. A device as claimed in claim 15, wherein the transformer core and the windings are sealed.

24. A method of optimizing the ratio of primary inductance to leakage inductance ($L_p/\Delta L$) of a transformer, wherein at least one of the transformer windings is formed by an insulated electrical conductor comprising a plurality of separate and distinguishable conductive cores, each core having an enamelled covering to insulate it from neighbouring cores, the cores being combined to form a multi-core elongate conductor which is covered by insulation tape wound in a helical path around the cores and which forms a common external insulating layer for the conductor, the primary and secondary windings are wound in the same winding space on a transformer core, and the turns of the two windings are intermingled to produce a desired primary inductance to leakage inductance ratio.

* * * * *